United States Patent [19]

Beall

[11] Patent Number: 4,497,237

[45] Date of Patent: Feb. 5, 1985

[54] GUITAR PICK

[76] Inventor: Mark A. Beall, 2965 Grouse, Wixom, Mich. 48096

[21] Appl. No.: 496,132

[22] Filed: May 19, 1983

[51] Int. Cl.[3] ..... G10D 3/16

[52] U.S. Cl. ..... 84/322

[58] Field of Search ..... 84/322

[56] References Cited

U.S. PATENT DOCUMENTS

| | | | |
|---|---|---|---|
| 215,029 | 8/1869 | Gardsby . | |
| 557,293 | 3/1896 | Wahl . | |
| 1,184,561 | 5/1916 | Napoletano | 84/322 |
| 1,263,740 | 4/1918 | Burdwise | 84/322 |
| 2,776,592 | 1/1957 | Di Preta | 84/322 |
| 3,648,558 | 3/1972 | Chennette | 84/322 |
| 3,699,838 | 10/1972 | Montgomery | 84/322 |
| 3,789,720 | 2/1974 | McIntrye | 84/322 |
| 4,270,433 | 6/1981 | Adamec | 84/322 |

*Primary Examiner*—Lawrence R. Franklin
*Attorney, Agent, or Firm*—Gifford, VanOphem, Sheridan, Sprinkle & Nabozny

[57] ABSTRACT

A guitar pick includes a pick element having a top edge thereon, and a band attached to the pick element adjacent its top edge. The band is relatively stiff but deformable and comprises two angularly disposed band portions meeting at a juncture 50. The thumb-adjacent portion subtends a 90° circular arc and is disposed in a plane perpendicular to the plane of the pick element, and 45° relative to the axis of the pick element. The other band portion subtends a 225° circular arc and is disposed in a plane 135° relative to the pick element. The pick element is thereby movable from a playing position to a position where it does not interfere with the player's hand.

13 Claims, 7 Drawing Figures

GUITAR PICK

BACKGROUND OF THE INVENTION

I. Field of the Invention

The invention relates to picks for playing string instruments, and more particularly, to guitar picks which are carried on the finger by a band.

II. Description of the Prior Art

Picks or plectra have long been used to play stringed instruments, such as the guitar. Conventionally these picks are somewhat flat, triangular pieces of a resiliently rigid material, such as plastic or metal. Some styles of picks are held between the thumb and one or more fingers of the player. These are drawn transversely across the string to evoke the desired sound. However, holding a pick in this manner is subject to some drawbacks. For example, if the pick is held too loosely during play, it can be dropped and easily lost, resulting in substantial inconvenience. On the other hand, holding the pick too tightly often reduces the level of flexibility in the hand and wrist, thereby interfering with the play of the instrument.

In order to overcome these and other drawbacks, many picks have been devised which incorporate means for holding the pick on the player's thumb or finger during play. For example, some picks have a ring or band attached to their top end, which is adapted for insertion of the thumb or finger of the player. These picks are thereby retained on the hand of the player, and dropping or losing them during play is prevented. Other finger-engaging means for retaining picks on the hand are known as well.

One problem with some known picks having finger-engaging means is that they engage the hand too firmly. This prevents moving the pick out of the way of the player's hand when such is desired. This may be desired when the player chooses one of several playing styles, for example, when a player wishes to quickly change from strumming to finger-picking styles, or vice versa. The pick, if left in the position for strumming, will interfere with the hand during the finger-picking style of play. Removal of the pick from the thumb or fingers, or its replacement on the hand, is time consuming during play and obviates the advantages of a pick attached to the hand.

SUMMARY OF THE PRESENT INVENTION

The present invention overcomes these and other problems by providing a pick which is attached to the hand, but is rotatable about the finger on which it is worn. The pick comprises a relatively stiff but deformable band attached to a pick element, or at near the top edge of the pick element. The faces of the pick bear pads which the finger and thumb grip during play. The ends of the band are adjustably received in a pair of grooves disposed between the pads and the corresponding pick faces, so that a loop is formed for insertion of the player's finger. The grooves are offset from one another sufficiently to assist the pick in moving along the finger somewhat when the pick is rotated about the finger. The band includes a means, preferably a bight, for restricting the degree of rotation of the pick about the finger. The pick is thus maintained on the hand and ready for immediate use, in a position where it will not interfere with the hand.

The band comprises a pair of angularly disposed portions. The shorter, thumb-adjacent band portion is somewhat circular and is attached to the pick element adjacent its top edge. This first portion subtends an angle of about 90°, in a plane disposed about perpendicularly to the plane of the pick element, but disposed about 45° relative to the axis of the pick element.

The other band portion also comprises a somewhat circular second arc attached to the pick element adjacent its top edge. This second portion subtends an angle of about 225°, in a plane disposed about 135° relative to the pick element.

BRIEF DESCRIPTION OF THE DRAWING

A better understanding of the present invention will be had upon reference to the following detailed description, when read in conjunction with the accompanying drawing, wherein like reference characters refer to like parts throughout these several views, and in which.

DETAILED DESCRIPTION OF THE PREFERRED EMBODIMENT OF THE PRESENT INVENTION

Figure 3:
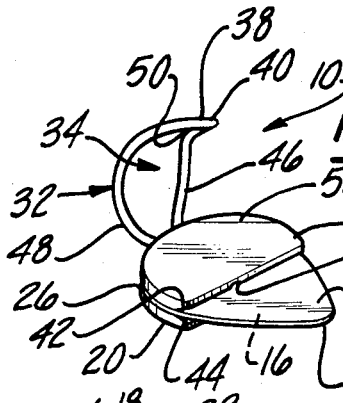
FIG. 3 is another perspective view of the preferred embodiment of the present invention.

With reference now to FIG. 3, the pick 10 according to the present invention is thereshown and first comprises a preferably somewhat triangular and substantially planar pick element 12. Conveniently, the pick element 12 is constructed from a resiliently rigid material, such as metal or plastic. Preferably, the pick element 12 comprises a conventional flat pick.

The pick element 12 comprises a pair of opposing faces 14 and 16. One of a pair of pads 18 and 20 is attached to each of the faces 14 and 16, respectively. The pads 18 and 20 are adapted to be gripped by the thumb and finger of the player, and cover only part of the faces 14 and 16. Preferably, the edges of the pads 18 and 20 are contoured in conformity with the pick element 12.

Figure 6:
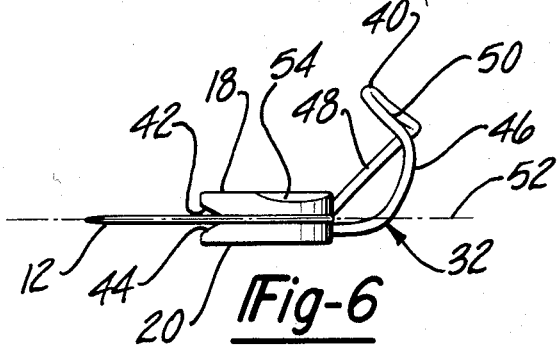
FIG. 6 is a side view of the preferred embodiment of the present invention.

The pads 18 and 20 can be constructed from a variety of materials, such as cork or plastic, or can be formed integrally with the pick element 12. Preferably, however, the pads 18 and 20 are constructed of wood, and are glued or otherwise fastened to the faces 14 and 16, respectively. A pair of edges 42 and 44 of the pads 18 and 20, opposite a top edge 26 of the pick element 12, are preferably bevelled so as not to present a sharp corner against which the pick element 12 might break (FIGS. 3 and 6).

Figure 4:
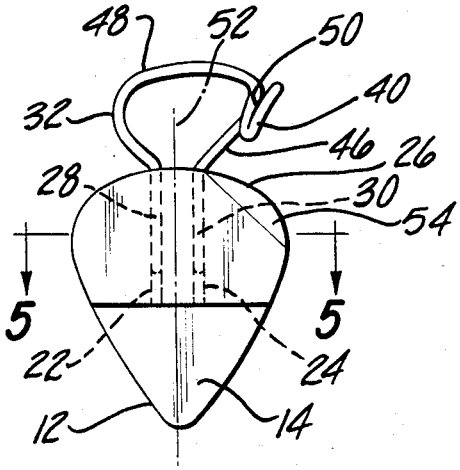
FIG. 4 is a top view of the preferred embodiment of the present invention.
Figure 5:
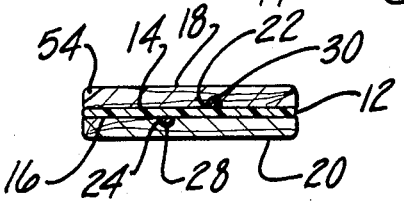
FIG. 5 is a cross-sectional view taken along line 5—5 of FIG. 4.
Figure 7:
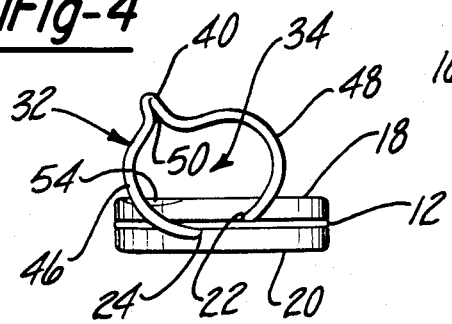
FIG. 7 is an end view of the preferred embodiment of the present invention.

The pads 18 and 20 are of a sufficient thickness to permit one of a pair of offset grooves 22 and 24, respectively, to be formed therein (FIG. 5). The grooves 22 and 24 are disposed between the pads 18 and 20 and the corresponding faces 14 and 16. The grooves 22 and 24 preferably extend substantially perpendicularly from the top edge 26 (FIG. 4) of the pick element 12, and are open at the top edge 26. In the preferred embodiment, the pick 10 is carried on the right hand of the player, and the grooves 22 and 24 are each slightly offset to the right of the axes of their respective faces 14 and 16, as viewed from the top edge 26 of the pick element 12 (FIG. 7).

Figure 1:
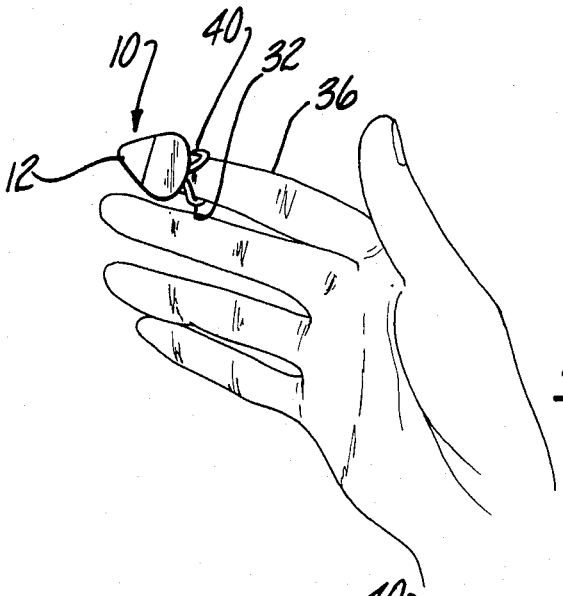
FIG. 1 is a perspective view of the preferred embodiment of the present invention.
Figure 2:
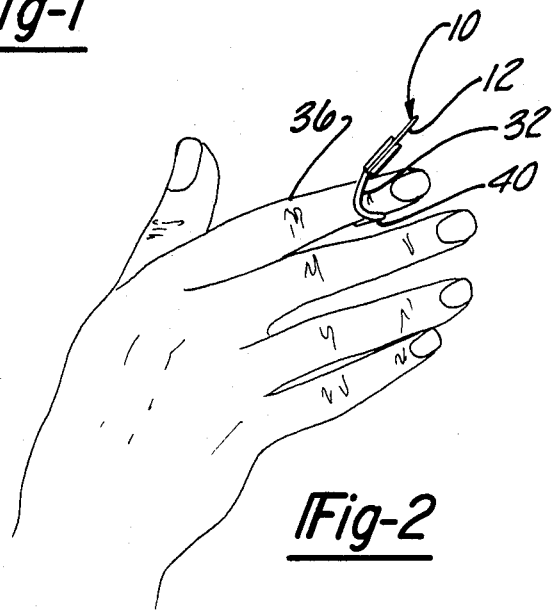
FIG. 2 is another perspective view of the preferred embodiment of the present invention.

The grooves 22 and 24 can extend all of the way across the pads 18 and 20, but are at least sufficiently long to each receive therein one of a pair of ends 28 and 30 of an adjustment band 32. The ends 28 and 30 are slidably received in the grooves 22 and 24 and are frictionally but adjustably engaged therein. The engagement of the ends 28 and 30 of the band 32 in the grooves 22 and 24 thereby forms a loop 34 for the insertion of a finger 36 of a player (FIGS. 1 and 2). The loop 34 is thereby disposed adjacent the top edge 26 of the pick element 12, but extends away from the pick element 12.

The band 32 is constructed of a relatively stiff but deformable material, so that it can grip the inserted finger 36 with sufficient strength to prevent the unintentional rotation of the pick 10 about the finger 36, yet not grip the finger 36 so strongly so as to prevent such rotation when desired. Preferably, the band 32 is constructed from a coated wire, such as a chenille stem.

As can best be seen in FIGS. 3, 4, 6 and 7, the band 32 is thereshown and comprises a pair of portions 46 and 48, angularly disposed relative to one another, meeting at a juncture 50. The shorter, thumb-adjacent portion 46 is somewhat circular and bears the band end 30 thereon. The thumb-adjacent portion 46 subtends an angle of about 90°, in a plane disposed about perpendicularly to the plane of the pick element 12, but disposed about 45° relative to the axis 52 of the pick element 12 (FIG. 4).

The other portion 48 of the band 32 is also somewhat circular and bears the band end 28 thereon. The other portion 48 subtends an angle of about 225°, in a plane disposed about 135° relative to the pick element 12 (FIG. 6).

It is also preferred that band 32 includes a means 38, at the juncture 50, for assisting the rotation of the pick 10 about the finger 36. Conveniently, this rotation assisting means 38 comprises a bend or an open bight 40 formed in the stiff but deformable band 32. The bight 40 is disposed on the side of the band 32 intended to be adjacent to the player's thumb when the pick 10 is in a position for play (FIG. 1). In the preferred embodiment, for the right hand, the bight 40 will be on the left side of the band 32, as shown in FIG. 7.

The use of the pick 10 of the present invention is straightforward. As is best shown in FIG. 1, the finger 36 of the player is inserted into the loop 34, with the bight 40 pointing somewhat towards the player's thumb. The preferred distance of insertion is about half to about two-thirds of the length of the pick element 12, although this distance can be varied according to the individual preference of the player. The ends 28 and 30 of the band 32 are adjusted in the grooves 22 and 24 to achieve a snug but comfortable fit of the loop 34 about the finger 36. This fit is sufficiently snug so that the pick element 12 can be easily manually rotated about the finger 36, yet does not freely rotate without the application of manual force.

The pick 10 is thus disposed in a position ready for play, and is gripped by the thumb and the finger 36 at the pads 18 and 20. The pick 10 can be removed from the finger 36 by twisting and pulling on the band 32 and the pick element 12. The bight 40 of the band 32 is preferably slightly expandable to ease this twisting rotation of the pick 10.

The pick 10 can also be quickly and easily manually positioned so that it remains attached to the hand, yet it does not interfere with the action of the hand, for example, when finger-picking of the guitar is desired. Such a noninterfering position is shown in FIG. 2. Starting with the pick 10 in the playing position, the thumb is shifted from the pad 20 to the rotation assisting means 38 and pushes it tangentially, rotating the pick 10 about the finger 36. If there is any rotational position where the thumb can no longer push against the rotation assisting means 38, the thumb can push or lift the pick element 12, if desired, to continue rotation. This rotation and pivoting of the pick element 12 can be done quickly and easily, so little time is lost moving the pick 10 to its noninterfering position. Preferably, the bight 40 will abut the knuckle of the finger 36 when this noninterfering position is achieved, thereby acting as a stop.

The moving of the pick 10 to such a noninterfering position is eased by the offset of the grooves 22 and 24. The shape of the loop 34 is somewhat helical on account of this offset. Rotation of the pick 10 about the finger 36 thus results in a small movement of the loop 34 away from the tip of the finger 36, and to its less interfering position. The moving of the pick 10 to its noninterfering position is also eased by the provision of a ramp surface 54 on the upper pad 18, adjacent the finger 36. The pick 10 will rotate about the finger 36 more easily, because there is no corner on the pad 18 to catch or rub against the finger 36.

If it is desired to carry the pick 10 on the left hand, the embodiment used should be a left-to-right mirror image of the preferred embodiment. The grooves 22 and 24 will then be slightly offset to the left of the axes of their respective pick faces 14 and 16. The positions of the band portions 46 and 48, the bight 40 and the ramp surfaces 54 will be reversed as well.

Although the preferred embodiment of the present invention has been described in terms of a flat, triangular pick disposed on a finger and held between the finger and thumb, the present invention is not limited to such use. The pick element 12 can have a teardrop or other shape, and can have curved faces instead of flat faces. The pick 10 can be disposed on the thumb, instead of on a finger, and rotation of the pick element 12 will thus occur by manipulation by one or more of the fingers, rather than by the thumb. The pick 10 can be disposed on the tip of any finger, with the pick element parallel to but either adjacent or opposite to the fingernail. In such a case the pads are not required, and the ends 28 and 30 of the band 32 can be attached to the pick element 12 in some other fashion. Alternatively, the band 32 can be continuous and can comprise a pair of legs passing through the grooves 22 and 24 and frictionally engaged therein. Other minor variations on the present invention can be constructed as well.

Having described my invention, however, many modifications thereto will become apparent to those skilled in the art to which it pertains without deviation from the spirit of the invention as defined by the scope of the appended claims.

I claim:

1. A pick comprising a pick element having an axis and a top edge, and a finger-engageable band attached to said pick element and forming therewith a finger receiving loop, said attachment occurring adjacent said top edge, said band including a projection extending away from said loop, wherein said pick element is rotatable about said finger when pressure is applied to said projection.

2. The invention according to claim 1, wherein said band comprises a relatively rigid but deformable band.

3. The invention according to claim 1, wherein said band comprises a pair of angularly disposed portions meeting at a juncture, one of said portions subtending about a 90° somewhat circular arc, and being disposed in a plane about 90° relative to said pick element, and being disposed about 45° relative to said axis; and the other of said portions subtending about a 225° somewhat circular arc, and being disposed in a plane about 135° relative to said pick element.

4. The invention according to claim 1, wherein said projection comprises a bight formed in said band.

5. The invention according to claim 1, wherein said projection is engageable by a finger other than said loop-engaged finger.

6. The invention according to claim 1, wherein said pick element comprises opposing faces, and wherein a pad is disposed on each of said faces.

7. The invention according to claim 6, wherein each of said pads comprises a groove adjacent said corresponding face.

8. The invention according to claim 7, wherein said band comprises two ends, one each of said ends being insertable into one of said grooves.

9. The invention according to claim 7, wherein a portion of said band is disposed in each of said grooves.

10. The invention according to claim 7, wherein said grooves are offset from the axes of their respective faces.

11. The invention according to claim 6, wherein one of said pads comprises a ramp surface.

12. The invention according to claim 6, wherein each of said pads comprises a bevelled edge adjacent their respective faces and opposite said top edge.

13. A guitar pick adapted to be slidably received on a finger, comprising:

a pick element, said pick element comprising a top edge and a pair of opposing faces, and having an axis centrally perpendicular to said top edge;

a pad on each of said opposing faces of said pick element, each of said pads comprising an offset groove in said pad adjacent said corresponding face; and an adjustable band comprising two ends, one each of said ends being insertable into one of said grooves, said band comprising a relatively stiff but at least partly deformable material, said band defining a loop engageable with a finger, wherein said band further comprises a pair of band portions joined at a juncture; one of said portions subtending a somewhat circular arc of about 90°, and being disposed in a plane about perpendicularly relative to the plane of said pick element and about 45° relative to said axis; and the other of said portions subtending a somewhat circular arc of about 225°, and being disposed in a plane about 135° relative to said pick element; and whereby said pick element is rotatable about said loop-engaged finger.

* * * * *